US008991515B2

(12) United States Patent
Morrison

(10) Patent No.: US 8,991,515 B2
(45) Date of Patent: Mar. 31, 2015

(54) FAIL-RESISTANT HAMMER ASSEMBLY FOR A VALVELESS PERCUSSIVE DRILL

(75) Inventor: Ward D. Morrison, Claremont, NH (US)

(73) Assignee: J.H. Fletcher & Co., Huntington, WV (US)

( * ) Notice: Subject to any disclaimer, the term of this patent is extended or adjusted under 35 U.S.C. 154(b) by 1730 days.

(21) Appl. No.: 12/089,560

(22) PCT Filed: Jan. 31, 2008

(86) PCT No.: PCT/US2008/052600

§ 371 (c)(1), (2), (4) Date: Apr. 8, 2008

(87) PCT Pub. No.: WO2008/095073

PCT Pub. Date: Aug. 7, 2008

(65) Prior Publication Data

US 2010/0155096 A1 Jun. 24, 2010

Related U.S. Application Data

(60) Provisional application No. 60/887,742, filed on Feb. 1, 2007.

(51) Int. Cl.

| | |
|---|---|
| ***E21B 4/14*** | (2006.01) |
| ***E21B 6/00*** | (2006.01) |
| ***E21B 1/00*** | (2006.01) |
| ***E21B 4/02*** | (2006.01) |
| ***B25D 9/12*** | (2006.01) |
| ***C21D 9/00*** | (2006.01) |
| ***E21B 1/02*** | (2006.01) |

(52) U.S. Cl.

CPC ..... *B25D 9/12* (2013.01); *C21D 9/0068* (2013.01); *E21B 1/02* (2013.01)

USPC ..... 173/1

(58) Field of Classification Search

CPC ..... E21B 4/14; E21B 6/00; E21B 1/00; E21B 4/02

USPC ..... 173/162.2, 204, 212, 135, 1, 78, 138, 173/200, 206, DIG. 4, 93; 91/174, 232, 233, 91/235, 405; 29/904, DIG. 2; 227/8, 10

See application file for complete search history.

(56) References Cited

U.S. PATENT DOCUMENTS

| | | | | |
|---|---|---|---|---|
| 1,988,504 A * | 1/1935 | McCullough | ..... | 428/657 |
| 2,604,419 A | 7/1952 | Herbenar | | |
| 2,696,367 A | 12/1954 | Robishaw | | |
| 3,559,753 A * | 2/1971 | Meri et al. | ..... | 173/137 |

(Continued)

FOREIGN PATENT DOCUMENTS

GB 928813 A 6/1963

*Primary Examiner* — Michelle Lopez
(74) *Attorney, Agent, or Firm* — King Schickli, PLLC

(57) ABSTRACT

In a valveless percussive drill of the hydraulic type and incorporating a hammer assembly, an "intermediate" shoulder between the head portion and cushion portion of a reciprocating piston engages the end face of a distributor or liner, rather than an interior bearing structure for the piston. This end face can be made harder than the ulterior bearing structure, which may include a surface made of a different material than the piston. Collectively, the result is a percussive drill with the hammer assembly incorporating the piston substantially less susceptible to failure due to galling as the result of contamination in the working fluid.

21 Claims, 12 Drawing Sheets

(56) References Cited

U.S. PATENT DOCUMENTS

| | | | | | |
|---|---|---|---|---|---|
| 3,666,024 | A | | 5/1972 | Beaumont | |
| 3,887,019 | A | * | 6/1975 | Reynolds et al. | 173/207 |
| 3,903,972 | A | * | 9/1975 | Bouyoucos et al. | 173/208 |
| 3,964,370 | A | * | 6/1976 | Rich | 91/395 |
| 3,991,835 | A | | 11/1976 | Bailey et al. | |
| 3,997,099 | A | * | 12/1976 | Morisaki | 228/117 |
| 4,064,788 | A | * | 12/1977 | Rich et al. | 91/395 |
| 4,126,192 | A | * | 11/1978 | Wallace | 173/105 |
| 4,179,983 | A | * | 12/1979 | Wallace | 92/85 B |
| 4,206,268 | A | * | 6/1980 | Roemer et al. | 428/643 |
| 4,517,878 | A | * | 5/1985 | Hashimoto et al. | 91/396 |
| 4,550,785 | A | | 11/1985 | Hibbard et al. | |
| 4,621,698 | A | | 11/1986 | Pittard et al. | |
| 5,040,618 | A | | 8/1991 | Morrison et al. | |
| 5,060,734 | A | | 10/1991 | Anderson et al. | |
| 5,396,965 | A | | 3/1995 | Hall et al. | |
| 5,543,236 | A | * | 8/1996 | Tanaka et al. | 428/614 |
| 5,810,100 | A | | 9/1998 | Samford | |
| 5,893,419 | A | | 4/1999 | Hodges | |

* cited by examiner

FAIL-RESISTANT HAMMER ASSEMBLY FOR A VALVELESS PERCUSSIVE DRILL

This application claims the benefit of U.S. Provisional Patent Application Ser. No. 60/887,742, filed Feb. 1, 2007, the disclosure of which is incorporated herein by reference.

TECHNICAL FIELD

The present invention relates to drills and, more particularly, to a percussive hammer assembly for use in connection with a hydraulic drill.

SUMMARY OF THE INVENTION

Various forms of percussive drills are known in the art. In one common form, the drill incorporates a hammer assembly comprising a tubular distributor that receives a piston in a telescoping fashion and allows it to reciprocate in order to perform the percussive drilling, such as in connection with the formation of boreholes in rock and the installation of roof anchors therein for mining applications. Pressurized fluid is introduced through radial inlets to cause the movement to and fro in connection with various circumferential passages formed in the exterior surface of the piston. An example of such a hammer assembly for use in connection with a valveless hydraulic percussive drill may be found in U.S. Pat. No. 4,550,785 to the present inventor, the disclosure of which is incorporated herein by reference.

Typically, the distributor and piston are made of steel hardened by way of heating. When assembled, the gap between the inner diameter of the distributor at the open end and the outer diameter of the piston is very small (usually thousandths of an inch), so as to form the desirable low friction fluid bearing. However, the presence of contaminants in the working fluid may "gall" and damage the piston. Even if damage does not result, the offset caused by the foreign object present one side of the annulus may cause the hard steel of the piston to engage the hard steel of the distributor frictionally, thus contributing to wear and early failure.

Accordingly, a need is identified for a hammer assembly for use in connection with a valveless hydraulic percussive drill that overcomes the foregoing limitations and is thus less resistant to failure.

SUMMARY OF THE INVENTION

In one aspect, the disclosed invention relates to an apparatus for forming part of a valveless percussive drill for use with a working liquid. The apparatus comprises a piston adapted for reciprocating movement in a longitudinal direction. The piston comprises an oversized head portion, a stem portion, a cushion portion, and at least one shoulder positioned at least partially between the head portion and the cushion portion. A tubular body is also provided for receiving the piston, which preferably includes at least an exterior surface that is generally symmetrical about a medial transverse plane. The body includes an interior surface resistant to galling due to the presence of any contaminant in the working liquid and a hardened end face for engaging the shoulder of the piston in the event of overtravel in the longitudinal direction.

In terms of materials, the interior surface may comprise bronze or ductile iron, while the body comprises a material harder than bronze, such as steel. The piston may comprise steel, including along an outer surface for engaging the interior surface of the body. As a result, the more lubricious and wear resistant material is adjacent the harder outer surface of the liner.

The tubular body preferably comprises a liner adapted for permitting at least the head portion of the piston to reciprocate. The end face of the body may be located adjacent an intake chamber for receiving the working fluid for causing the piston to move relative to the liner. A gap between the piston and at least the head portion of the tubular body defines an annulus for receiving the working fluid. The tubular body may further comprise a distributor adapted for receiving and permitting at least the stem portion of the piston to reciprocate.

Preferably, the liner for receiving the head portion of the piston contacts the end face of the distributor, such as along a shoulder. In the event of overtravel in the longitudinal direction, this engagement advantageously prevents the cushion portion of the piston from engaging a corresponding transverse face within the tubular body. As a result, the resistance to failure and accordingly the service life both increase.

Still a further aspect of the invention is a method of forming part of a valveless percussive drill for use with a working liquid. The method comprises providing a piston with an oversized head portion, a stem portion, a cushion portion, and at least one shoulder at least partially between the head portion and the cushion portion. The method further comprises positioning the piston at least partially in a tubular body having an interior surface resistant to galling and a hardened end face for engaging the shoulder of the piston. In the event of overtravel in the longitudinal direction, this engagement advantageously prevents the cushion portion of the piston from engaging a corresponding transverse face within the tubular body. As a result of practicing this method of manufacture, the resistance to failure and accordingly the service life both increase. In one embodiment, the providing step comprises providing a gap between the interior surface and an exterior surface of the piston, as well as a liquid in the gap. The method may further include the step of drilling using the valveless percussive drill.

A further aspect of the disclosure is a method of manufacturing a liner assembly for use in connection with a piston in a percussive drill. The manufacturing method comprises forming a tubular body of a first material for receiving the piston, the body having an interior surface and an end face, and providing a lining formed of a second material resistant to galling along at least a portion of the interior surface for engaging the piston. After the providing step, the method comprises hardening at least the end face of the body.

Preferably, the hardening step comprises heat treating the body to a temperature that does not impact negatively the second material of the lining. When the second material comprises bronze, and the heat treating does not cause the bronze to exceed a temperature of approximately 620° C. Preferably, the forming and providing steps comprise creating at least a portion of the body including the portion of the interior surface with the lining from a blank comprising the first and second materials.

In a related aspect, an apparatus for performing drilling is disclosed. The apparatus comprises a valveless percussive drill including: (1) a piston adapted for reciprocating movement in a longitudinal direction, the piston having an oversized head portion, a stem portion, a cushion portion, and at least one shoulder positioned at least partially between the head portion and the cushion portion; and (2) a tubular body for receiving the piston, the body having an interior surface resistant to galling and a hardened end face for engaging the shoulder of the piston in the event of overtravel in the longitudinal direction.

A further related aspect is an apparatus for forming part of a valveless percussive drill for use with a working liquid. The apparatus comprises a piston having an oversized head portion and at least one shoulder, and a tubular body having a bore for receiving the piston, the body including a cushion pocket. The shoulder engages a portion of the tubular body external to the cushion pocket if the piston overtravels within the bore.

Yet another aspect of the invention is an apparatus for forming part of a valveless percussive drill for use with a working liquid. The apparatus comprises a piston having an oversized head portion, and a tubular body having a bore for receiving the piston, the body including a cushion pocket. The piston includes means for engaging the tubular body external to the cushion pocket. Preferably, the means for engaging comprises an annular shoulder.

A further aspect of the disclosure relates to an improvement in a valveless percussive drill including a piston adapted for reciprocating movement within a tubular body formed of a first material and including a driving chamber associated with a port, a drain annulus, and a pressure seal annulus. The improvement comprises a lining formed of a second material resistant to galling along at least a portion of the interior surface and a hardened end face for engaging the piston in the event of overtravel. The tubular body may comprise a liner or a distributor. The piston may comprise an oversized head portion, a stem portion, a cushion portion, and at least one shoulder positioned at least partially between the head portion and the cushion portion and adapted for engaging the tubular body.

DETAILED DESCRIPTION OF THE INVENTION

Figure 1:
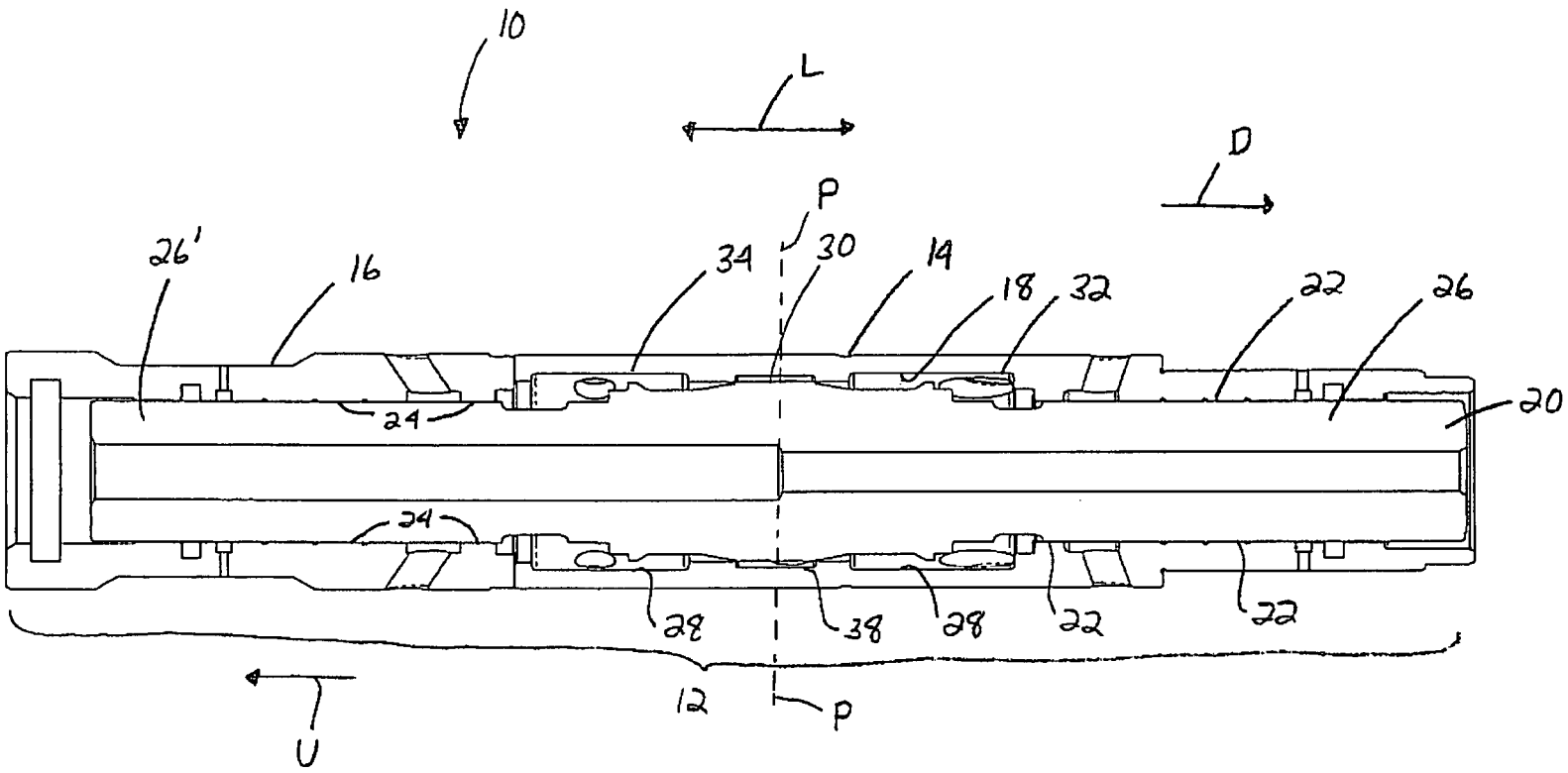
FIG. 1 is a side cross-sectional view of a hammer assembly constructed in accordance with the preferred embodiment of the invention.
Figure 2:
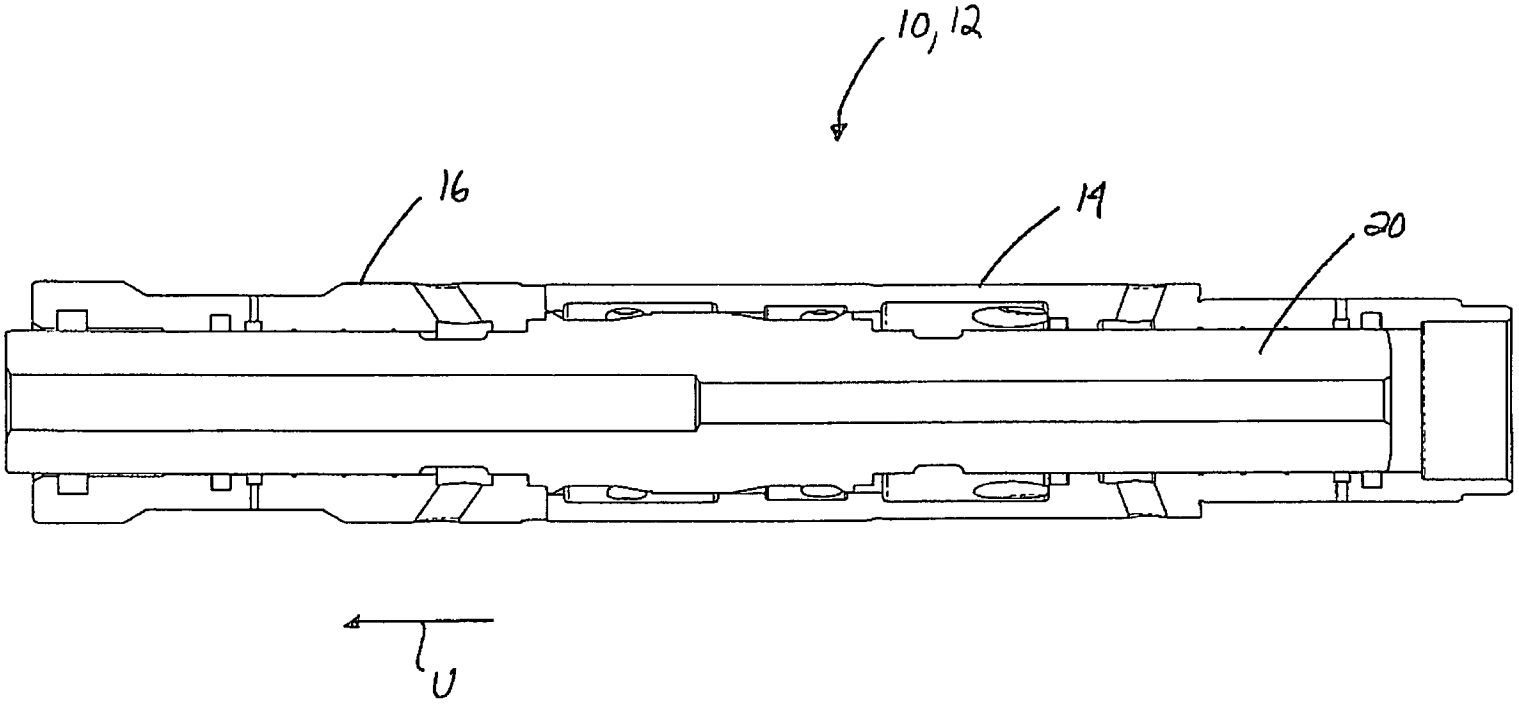
FIG. 2 is a side cross-sectional view of a hammer assembly constructed in accordance with the preferred embodiment of the invention.
Figure 5:
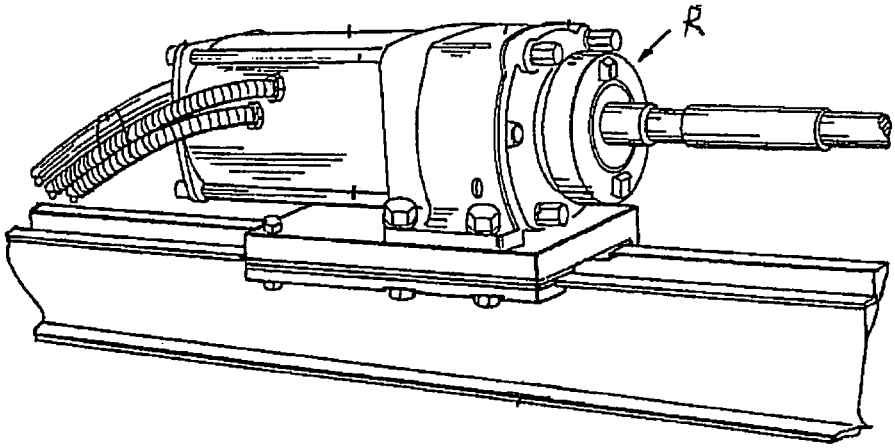
FIG. 5 illustrates a percussive drill.

With reference to FIGS. 1-3, a hammer assembly 10 according to one possible embodiment is shown and will now be described in detail. In the illustrated preferred embodiment, and with initial reference to FIG. 1, this hammer assembly 10 includes an elongated annular liner assembly 12 comprising an elongated member or liner 14 and a mating elongated distributor 16. As illustrated, the distributor 16 is coaxially disposed adjacent a rearward end of the liner 14. Both the liner 14 and distributor 16 include various ports and inlets for receiving a working liquid or other non-compressible fluid. Other internal parts of an associated valveless percussive drill R (see FIG. 5) are not shown for purposes of clarity, and specific details of its operation are not provided, but both of these are well-known in the art and can be found in the '785 patent.

The coaxially communicating inner peripheries of the liner 14 and distributor 16 form a coaxial through bore 18 for receiving an elongated, stepped cylindrical piston 20 disposed for reciprocal movement in a longitudinal direction L. This bore 18 includes axially spaced forward and rearward bearing portions 22, 24, which slidably support axially spaced forward and rearward stem portions 26, 26' of piston 20. An enlarged diameter intermediate portion 28 of the bore 18 between the respective bearing portions 22, 24 receives a generally stepped cylindrical intermediate or head portion 30 of piston 20. Respective variable volume upstroke and downstroke (note action arrows U and D) piston driving chambers 32, 34 are formed adjacent respective forward and rearward ends of piston head 30 by axially spaced annular peripheral clearance spaces between the head 30 and bore portion 28. Piston 20 cooperates with bore 18 to provide for porting of pressurized motive fluid alternately to and from driving chambers 32, 34 for self-excitation of the piston 20, as described in more detail in the '785 patent.

Generally, piston 20 is at least externally symmetrical about its medial transverse plane P-P, so only one axial half portion of the illustrated piston, i.e., the upstroke half, will be described. For purposes of this discussion, the remaining piston half portion, i.e., the downstroke half, may be considered substantially similar to the upstroke half. The reference characters applied to the downstroke half are primed characters to correspond to the hereinbelow described parts of the upstroke half of piston 20.

Figure 1A:
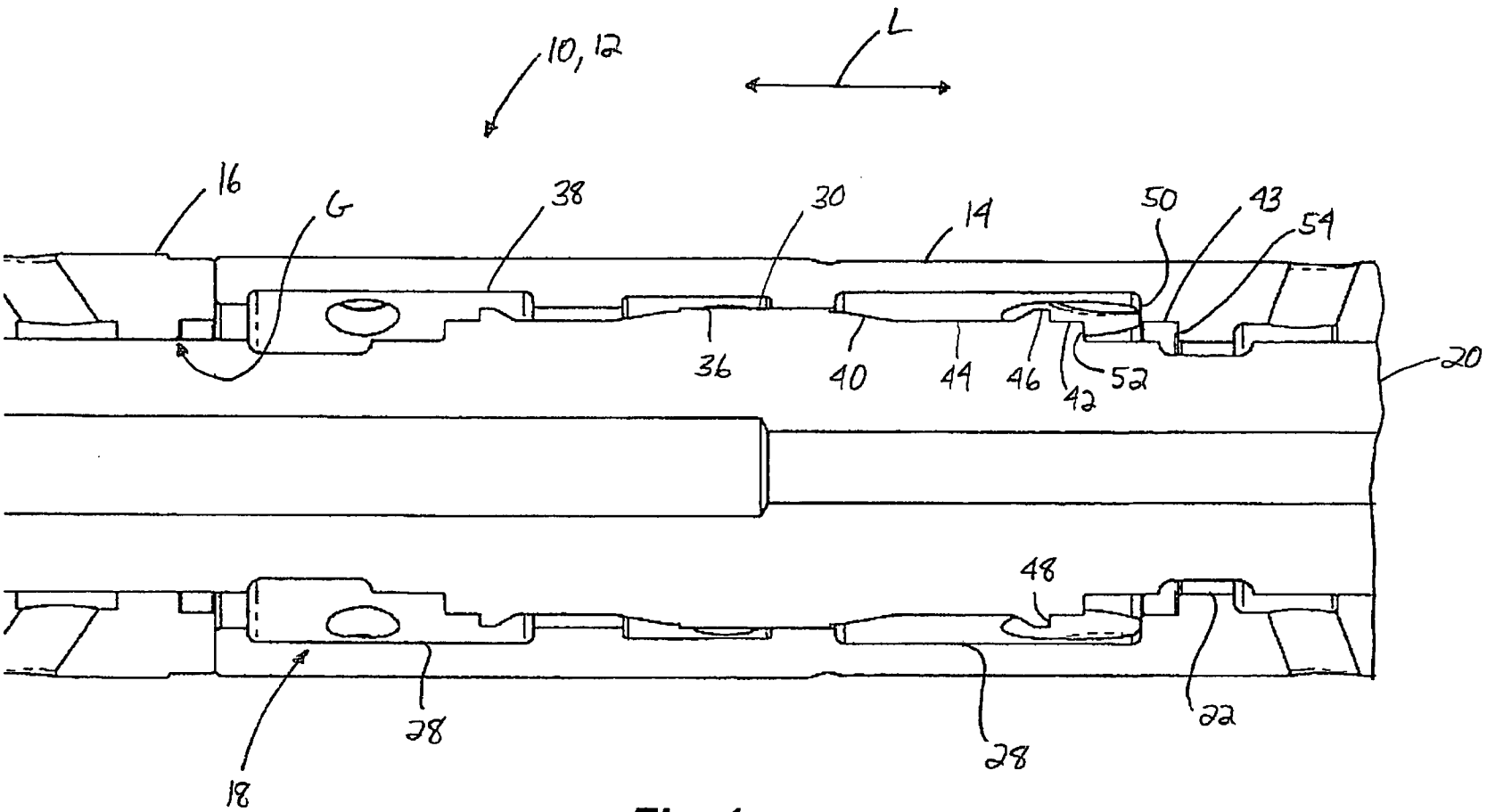
FIG. 1*a* is an enlarged, cutaway view of a portion of the assembly of FIG. 1.

With reference to FIG. 1*a*, the head portion 30 of piston 20 comprises a central, axially extending annular land 36. This land 36 comprising the head portion 30 is axially slidable within bore portion 28 in cooperation with an exhaust annulus 38 to provide exhaust porting or valving during reciprocation of the piston 20.

A second land 40 is formed with its largest diameter end portion, which is smaller than the diameter of land 36, located adjacent the axial end of land 36. This second land 40 tapers radially and inwardly therefrom along its axial extent at a taper angle with respect to the central longitudinal axis of piston 20, As a result, land 40 provides controlled porting of exhaust fluid by uniformly increasing the outflow of pressure fluid to exhaust as the exhaust annulus 38 opens. Land 40 thereby reduces the possibility of undesirable fluid cavitation which might occur as a result of uncontrolled fluid pressure release to the exhaust. Additionally, the taper on land 40 tends to promote non-turbulent flow of pressurized fluid from the respective driving chambers 32, 34 to the exhaust chamber 38 as piston head 30 alternately moves therein during reciprocation so as to reduce any tendency of the fluid to retard piston movement.

Axially spaced in the longitudinal direction L from the outer axial end of land 40 is an annular land 42. This land 42 cooperates with an annular cavity 43 formed adjacent the interface of bore portion 28 and forward bearing surface 22 to provide a fluid cushion for the piston. Extending axially intermediate the axially adjacent ends of lands 40 and 42 is an intervening portion 44, which may be formed with a uniform or a tapering diameter, depending upon the respective diameters of the portions of lands 40 and 42 joined thereby. Land 42 extends axially in the longitudinal direction L to terminate adjacent the stem portion 26.

Figure 1B:
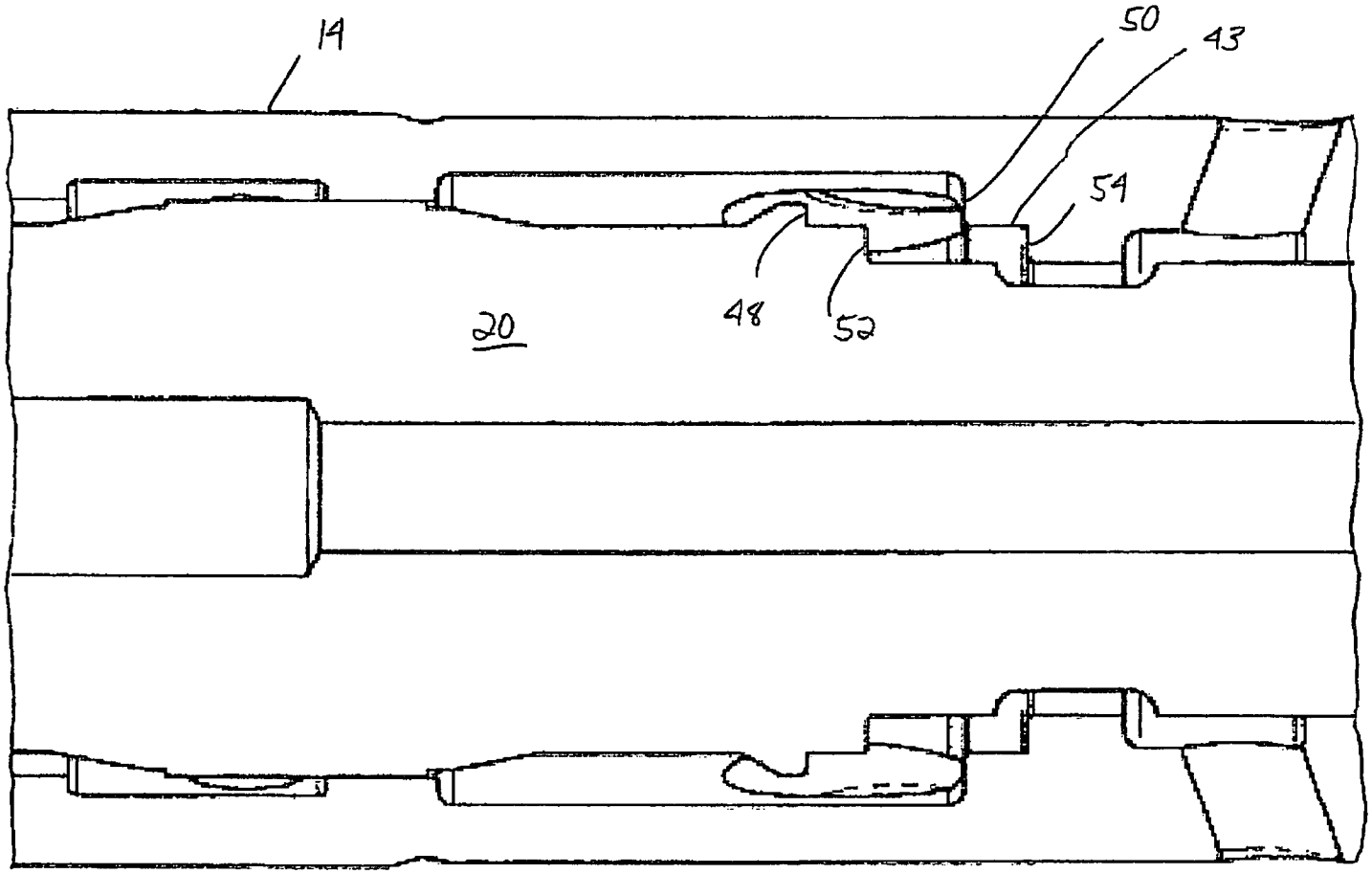
FIG. 1*b* is a further enlarged, cutaway view of a portion of the assembly of FIG. 1.

In accordance with one aspect of the invention, and with reference to FIGS. 1*a* and 1*b*, an outwardly projecting shoulder 46 is provided on the piston 20. Most preferably, this shoulder 46 is formed on the intervening portion 44 at least partially positioned and extending between first and second lands 40, 42. Preferably, the shoulder 46 extends circumferentially about the piston 20 and provides an engagement face 48 extending generally transverse to the longitudinal direction L (that is, the direction of reciprocation).

In the event of excess over-travel of the piston 20 during reciprocation, this engagement face 48 contacts and mates with an end or "stop" face 50 of the liner 14 (or distributor 16 at the opposite end), which forms or defines part of the chamber for receiving the piston 20 and the associated working fluid forming the bearing. This engagement prevents a transverse end or "cushion" face 52 associated with land 42 from contacting the corresponding transverse end or "cushion" face 54 of the liner 14. Together, this face 54 and the adjacent annular wall of the cavity 43 may be considered to define a cushion pocket for receiving a portion of the working fluid. The importance of this feature will be better understood upon reviewing the following description.

The liner 14 and distributor 16 are typically made of durable materials, such as hardened steel, in order to provide superior wear resistance against the reciprocating piston 20. When assembled, the gap G between the inner diameter of the bearing portion 24 of the distributor 16 and the outer diameter of the corresponding surface of the stem 26' of the piston 20 is very small (thousandths of an inch), so as to form the desirable low friction fluid bearing. However, the presence of contaminants in the working fluid or other foreign objects may "gall" and damage the piston 20. Even if damage does not result, the resulting offset adjacent one side of the annulus formed between the structures may cause the hard steel of the piston 20 to engage the hard steel of the bearing portions 22, 24 frictionally, thus contributing to excessive wear and concomitant early failure.

To prevent this, a softer material, such as bronze or ductile iron, may be used to form the bearing portions 24 of the distributor 16 in which the piston 20 reciprocates. Such materials are more lubricious than steel, as well as relatively soft. Hence, they do not have the same problems with galling as the steel surface, even if the outer surface of the stems 26, 26' for some reason engages the corresponding bearing surfaces 22, 24. However, the use of such linings (and, in particular, the process used to form such a distributor 16 with a bronze surface along the bearing portion 24) prevents the steel distributor once formed from being fully hardened by way of heat treatment without potentially impacting the lining material (especially when formed of bronze). Thus, even with the use of a bronzed-lined distributor 16, the "cushion" end face 54 of liner 14 (or end face 54' of distributor 16) is not fully hardened and could fail upon being repeatedly engaged by a corresponding surface of the piston 20 as it reciprocates.

Reference is now made to FIG. 2 to describe a possible solution to this problem forming an aspect of the disclosed invention. As should be appreciated, this figure shows the similar arrangement described above with respect to FIG. 1 at the opposite end of the piston 20, adjacent the distributor 16 that contacts the liner 14 along the end face 50'. The piston 20 is illustrated in the maximum upstream location (note action arrow D) relative to the liner assembly 12.

Figure 2A:
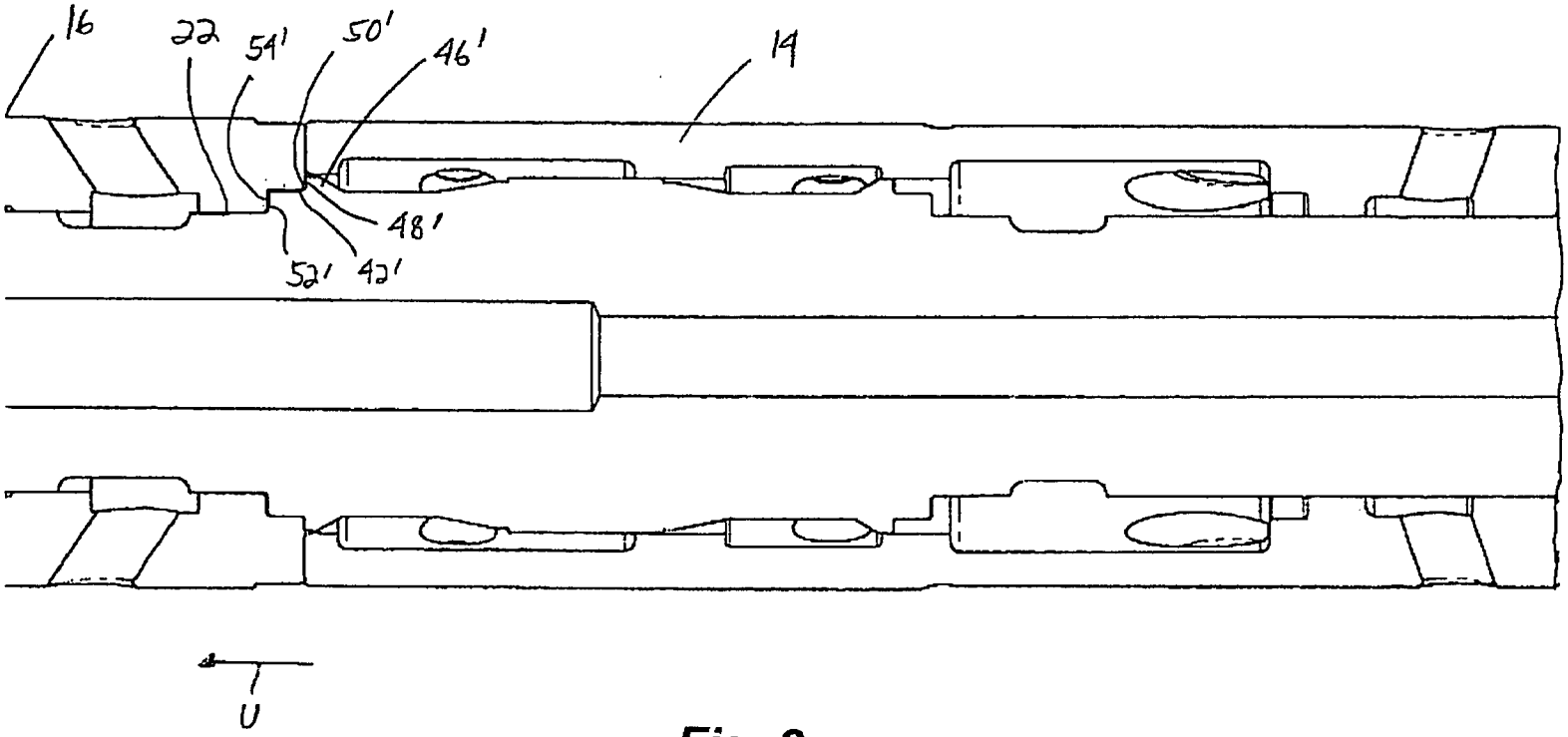
FIG. 2*a* is an enlarged, cutaway view of a portion of the assembly of FIG. 2.
Figure 2B:
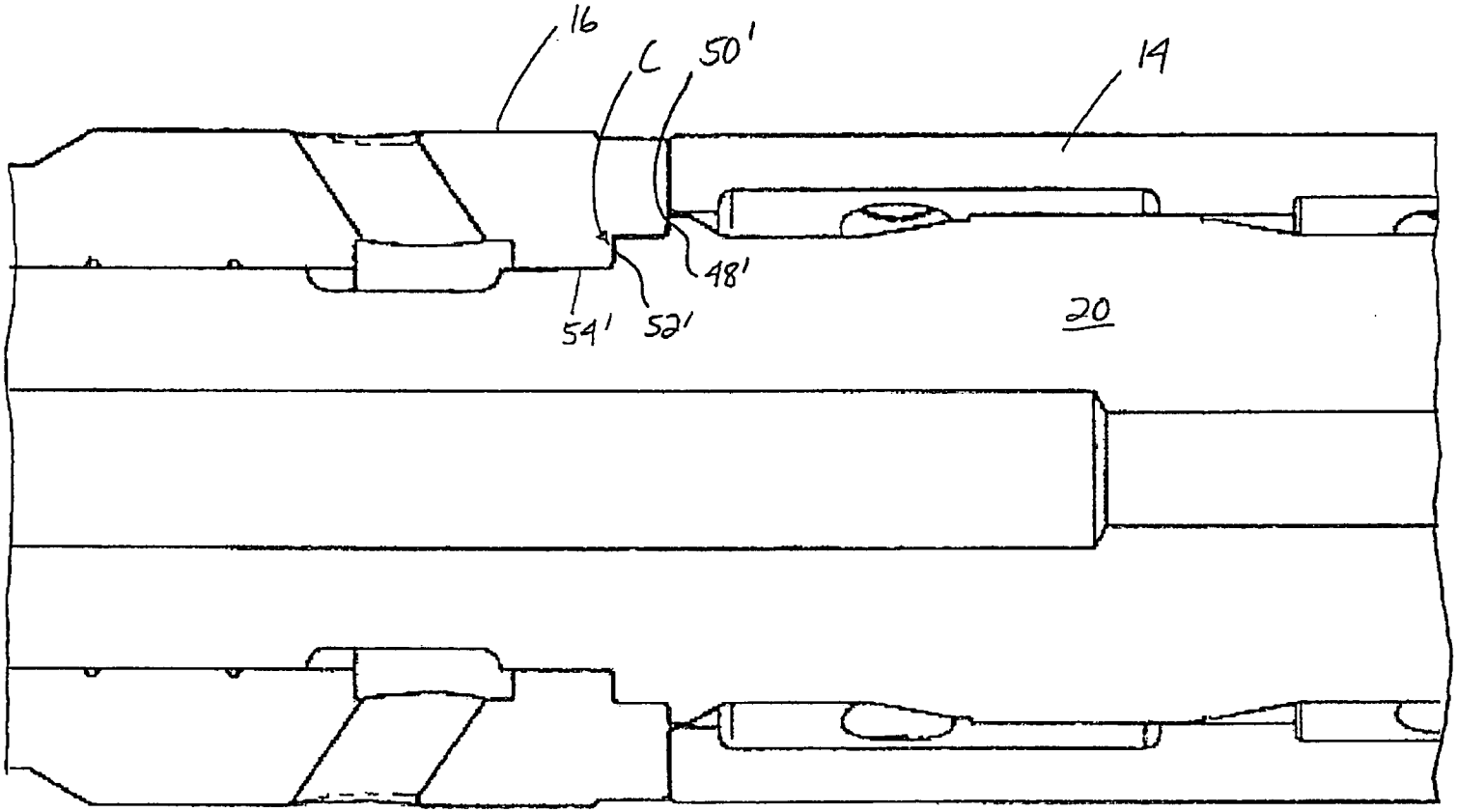
FIG. 2*b* is a further enlarged, cutaway view of a portion of the assembly of FIG. 2.

With specific reference to FIGS. 2*a* and 2*b*, if the piston 20 over-travels rearwardly during reciprocation to this maximum position, the hardened engagement face 48' of the annular shoulder 46' formed on the piston 20 directly contacts and engages this end or stop face 50' (which of course is external to the cushion pocket formed by the face 54' and the annular wall of cavity 43). Unlike the "cushion" end face 54', which cannot be easily hardened because of the desirability of providing a wear-resistant lining along the bearing portion 22 of the distributor 16, the end face 50' can be fully hardened, such as through induction hardening or like processes that do not in anyway impact the desired functionality of the lining.

Engagement between this stop face 50' and the matching engagement face 48' of the shoulder 46' thus prevents the cushion face 52' of the piston 20 from directly engaging the corresponding cushion face 54' of the distributor 16. This ensures that the desirable cushion is maintained (note the representation of fluid cushion C between faces 52', 54' in FIG. 2*b*). This results in a hammer assembly 10 that is not only less resistant to failure as the result of contaminants in the working fluid, but also able to guard against over-travel in a more effective manner than in the prior art. Together, these features contribute to a substantially longer service life.

Figure 3A:
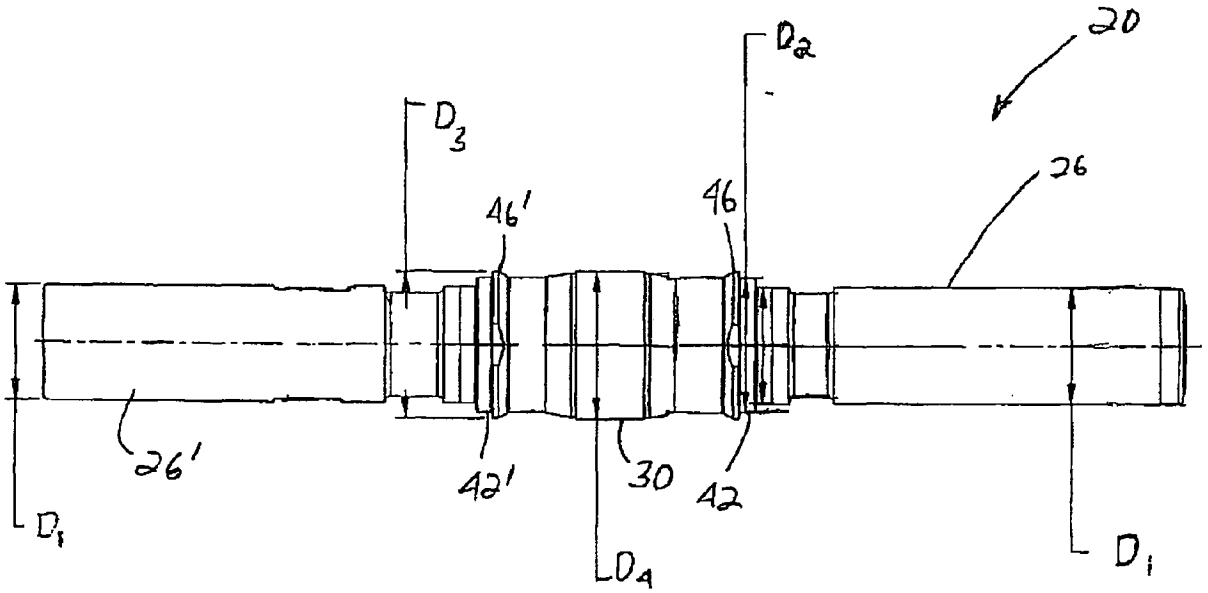
FIG. 3*a* is a side elevational view of one embodiment of a piston for use in connection with the disclosed hammer assembly.
Figure 3B:
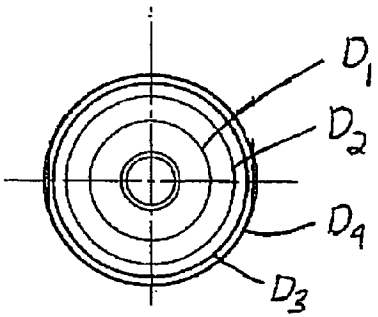
FIG. 3*b* in an enlarged end view of the piston of FIG. 3*a;*

With reference now to FIGS. 3*a* and 3*b*, a particularly preferred embodiment of the inventive piston 20 is shown. As can be seen, the nominal diameter $D_1$ of the stem 26, 26' is less than the nominal diameter $D_2$ of the cushion land 42, 42' on either side of the piston 20. The nominal diameter $D_3$ of the shoulder 46, 46' is greater than the nominal diameter $D_2$ of the cushion land 42, but preferably less than the nominal diameter $D_4$ of the head portion 30 (or, in other words, $D_4>D_3>D_2>D_1$). The two diameters $D_3$,$D_4$ could match, but the shoulder diameter $D_3$ should always be smaller in the illustrated embodiment to avoid any interference with the lined surfaces of the bearing portions 22, 24 within the bore 18.

Figure 4A:
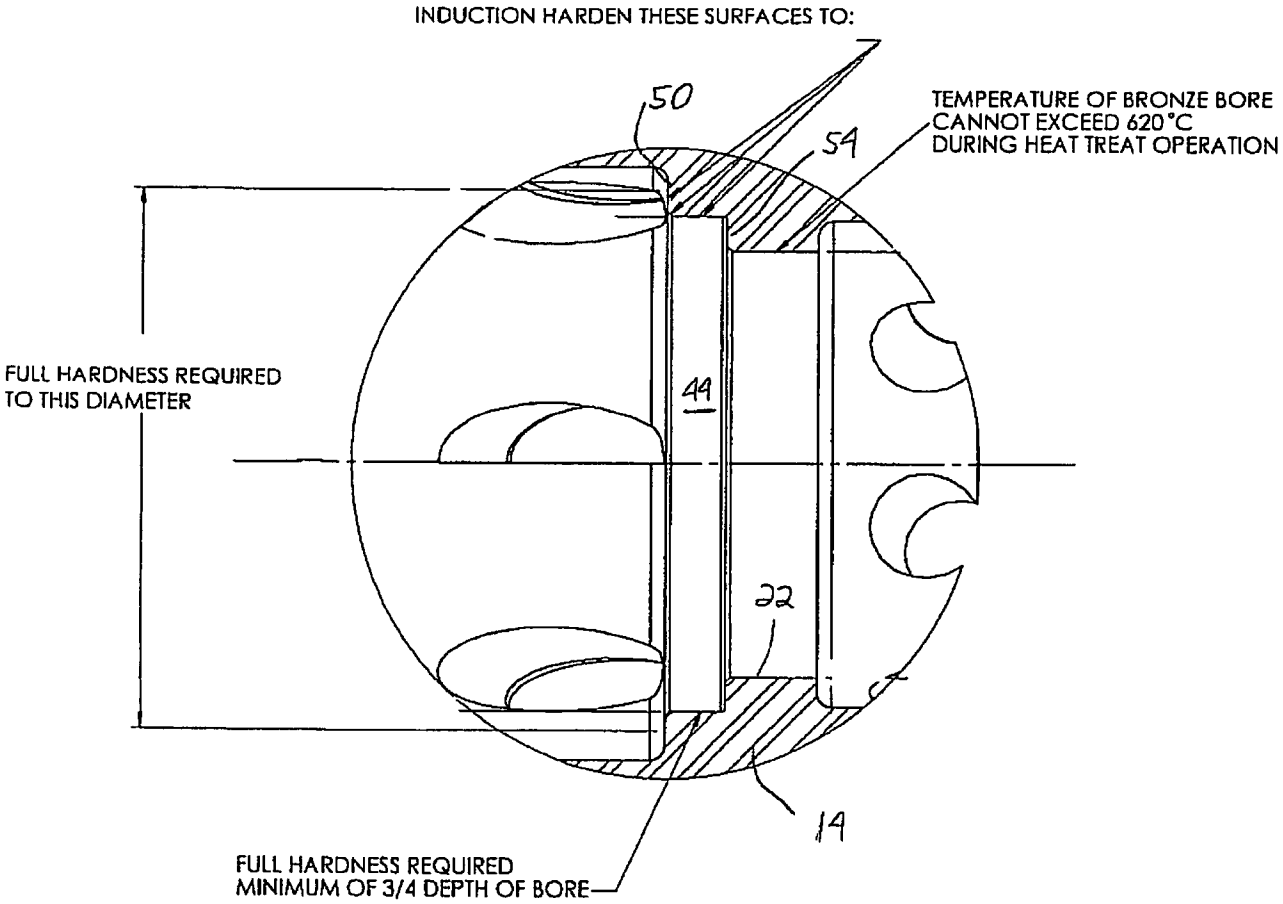
FIGS. 4*a* and 4*b* provide exemplary manufacturing techniques for the distributor and liner.
Figure 4B:
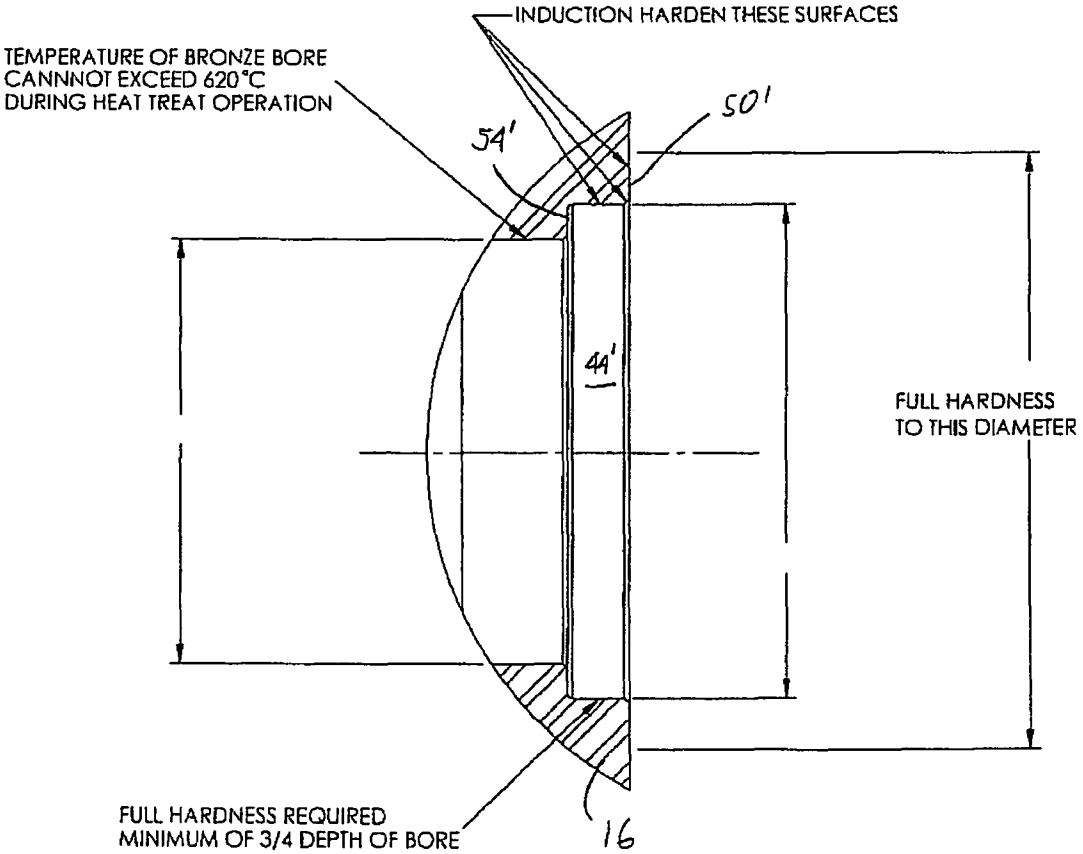

In accordance with another aspect of the invention, and referring to FIGS. 4*a* and 4*b*, a method of manufacturing a tubular body (either liner 14 or distributor 16) for use in connection with a hydraulic, piston-driven percussive drill or the like is described. The method comprises providing a first, preferably softer and more gall-resistant material along at least a portion of the interior of the different second harder material forming the body so as to form a bearing surface. The method further comprises the step of surface hardening an end face of the body for engaging the piston after the application of the material to form the bearing surface. Preferably, the softer material is bronze, in which case the step of hardening the end face involves heating the body without exceeding a temperature or otherwise being worked in a manner that might negatively impact the bearing material used. Most preferably, the bronze lining on steel is achieved by machining blanks comprising bronze bonded to steel (with the steel being a maximum hardness of about Rc=32), in which case this temperature limit is at or below the melting point of bronze (approximately 620° C.). Such blanks are available from Kugler Bimetal SA of Geneva, Switzerland.

Figure 6:
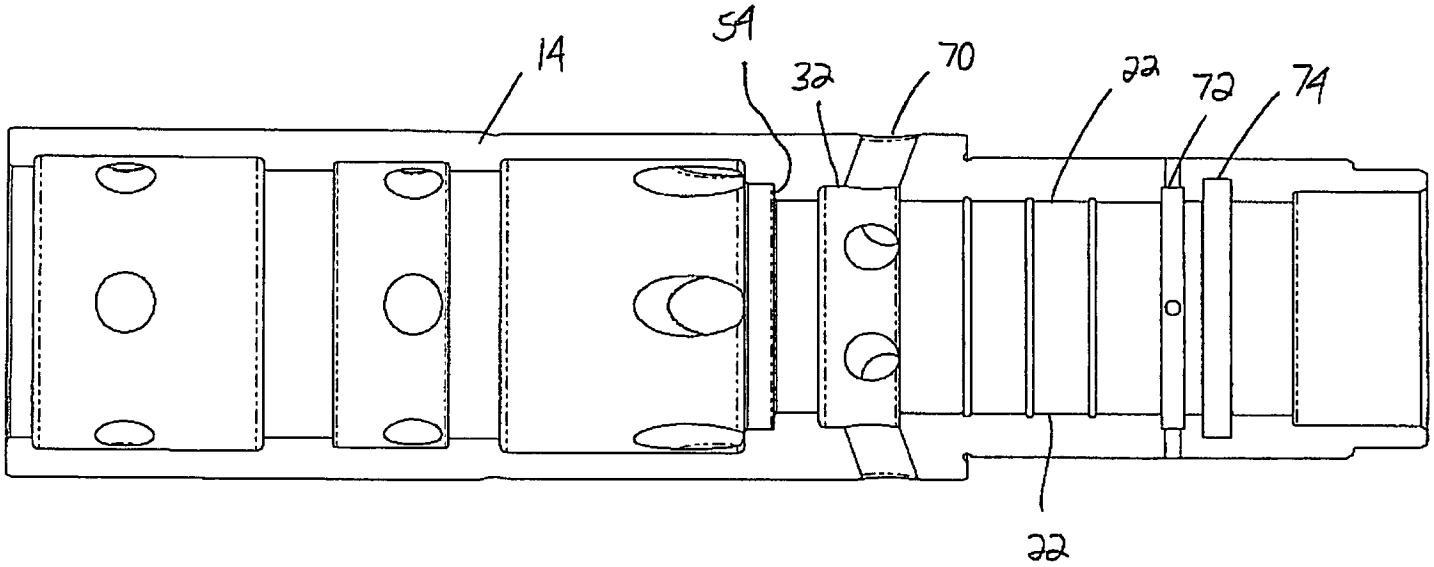
FIG. 6 illustrates a liner for a valveless percussive drill and formed using the manufacturing technique forming part of the disclosure.
Figure 7:
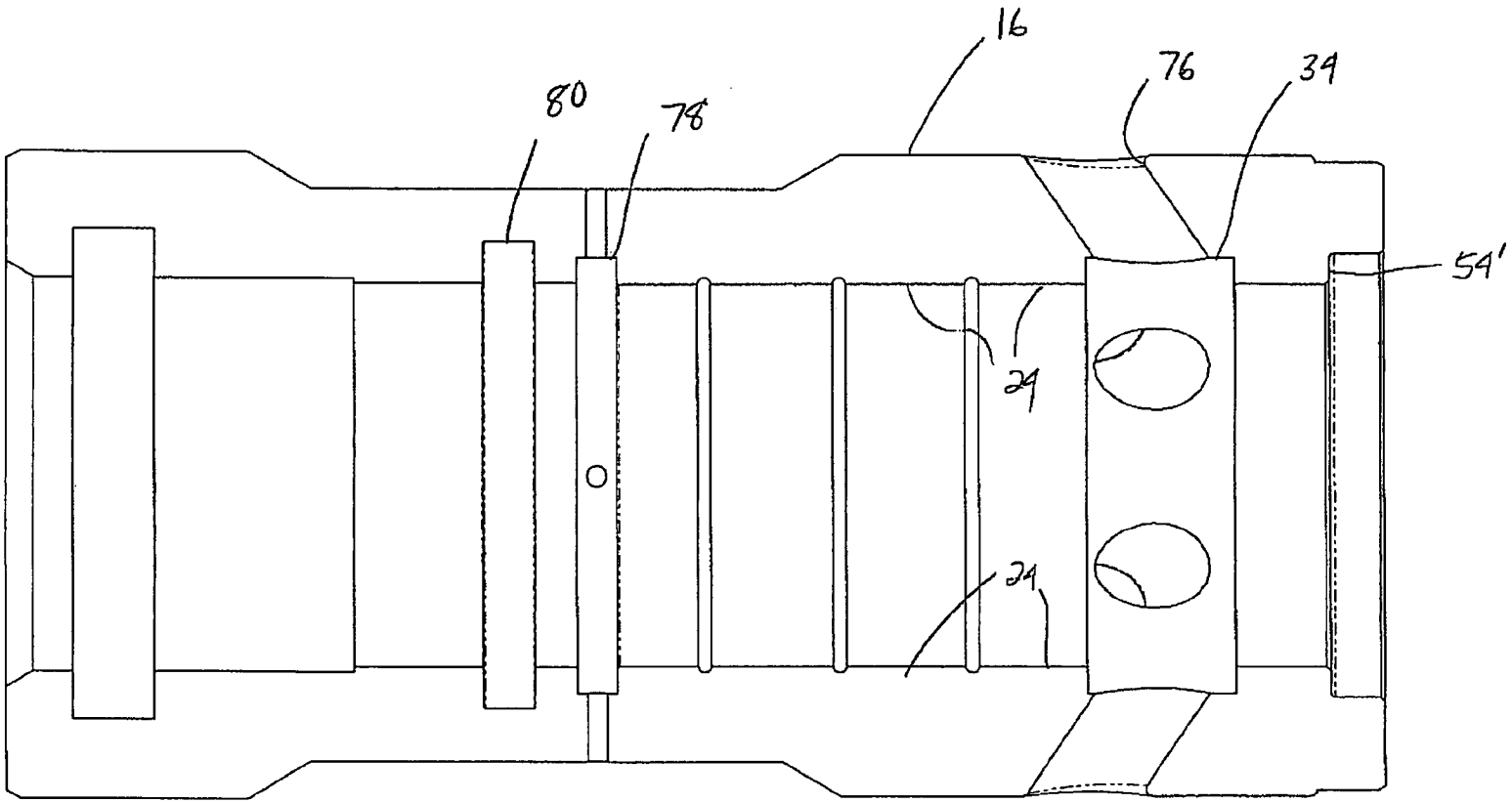
FIG. 7 illustrates a distributor for a valveless percussive drill and formed using the manufacturing technique forming part of the disclosure.

FIGS. 6 and 7 illustrated a liner 14 and distributor 16 for a valveless percussive drill R including a softer and more gall-resistant material along at least a portion of the interior of the different second harder material forming the body so as to form the desired bearing surface. In a specific example, the softer material comprises bronze, and is provided along the bearing surfaces 22, 24 of the liner 14, and distributor 16, respectively. This may be accomplished using the above-described manufacturing technique(s).

Still more specifically, and referring to FIG. 6, the material may be applied to the bearing surfaces 22 of the liner 14 between the driving chamber 32 associated with a port 70, a drain annulus 72, and a pressure seal annulus 74. These locations are of course remote from the cushion end face 54, which would not include the softer material and could thus be surface treated and hardened in the desired manner (and thus potentially used in connection with a piston like the one shown in the '785 patent that would engage this face in the event of overtravel in the downstream direction).

Similarly, referring to FIG. 7, the material may be applied to the bearing surfaces 24 of the distributor 16 between the driving chamber 34 associated with a port 76, a drain annulus 78, and a pressure seal annulus 80. These locations are of course remote from the cushion end face 54', which would not include the softer material and could thus be surface treated and hardened in the desired manner (and thus potentially used in connection with a piston like the one shown in the '785 patent that would engage this face in the event of overtravel in the upstream direction).

The foregoing description of various embodiments of the present invention are presented for purposes of illustration and description. This illustration and description is not intended to be exhaustive or to limit the invention to the precise forms disclosed. Obvious modifications or variations are possible in light of the above teachings. The embodiments described provide the best illustration of the principles of the invention and its practical applications to thereby enable one of ordinary skill in the art to utilize the invention in various embodiments and with various modifications suited to the particular use contemplated. All such modifications and variations are within the scope of the invention.

The invention claimed is:

1. An apparatus for forming part of a valveless percussive drill for use with a working liquid, comprising:

a piston adapted for reciprocating movement in a longitudinal direction, the piston having an oversized head portion, a stem portion, a cushion portion, and at least one shoulder positioned at least partially between the head portion and the cushion portion; and a tubular body for receiving the piston, the body having a cushion pocket for engaging the cushion portion, an interior surface resistant to galling due to the presence of any contaminant in the working liquid and a hardened end face for engaging the shoulder of the piston in the event of overtravel in the longitudinal direction.

2. The apparatus of claim 1, wherein the interior surface comprises bronze or ductile iron, and the body comprises a material harder than bronze.

3. The apparatus of claim 1, wherein the piston comprises steel, including along an outer surface for engaging the interior surface of the body.

4. The apparatus of claim 1, wherein the tubular body comprises a liner adapted for permitting at least the head portion of the piston to reciprocate.

5. The apparatus of claim 4, wherein the end face defines a chamber for receiving the working fluid for causing the piston to move relative to the liner.

6. The apparatus of claim 1, wherein the tubular body comprises a distributor adapted for receiving and permitting at least the stem portion of the piston to reciprocate.

7. The apparatus of claim 6, wherein a liner for receiving the head portion of the piston contacts the end face of the distributor.

8. The apparatus of claim 1, wherein a gap between the piston and at least the head portion of the tubular body defines an annulus for receiving the working fluid.

9. The apparatus of claim 1, wherein at least an exterior surface of the piston is generally symmetrical about a medial transverse plane.

10. The apparatus of claim 1, wherein engagement between the hardened end face and the shoulder of the piston in the event of overtravel in the longitudinal direction prevents the cushion portion of the piston from engaging a corresponding transverse face within the tubular body.

11. The apparatus according to claim 1, wherein the shoulder includes a face baying a first plane parallel to a second plane parallel to the end face.

12. The apparatus according to claim 1, wherein the piston further includes a tapered portion positioned between the oversized head portion and the at least one shoulder.

13. The apparatus according to claim 1, wherein the end face is perpendicular to the longitudinal direction and the shoulder includes a face parallel to the end face.

14. A method of forming part of a valveless percussive drill for use with a working liquid, comprising:

providing a piston with an oversized head portion, a stem portion, a cushion portion, and at least one shoulder at least partially between the head portion and the cushion portion;

positioning the piston at least partially in a tubular body having a cushion pocket for engaging the cushion portion, an interior surface resistant to galling and a hardened end face for engaging the shoulder of the piston in the event of overtravel in a longitudinal direction.

15. The method of claim 14, wherein the providing step comprises providing a gap between the interior surface and an exterior surface of the piston.

16. The method of claim 15, further comprising the step of providing a liquid in the gap.

17. A method of manufacturing a liner assembly for use in connection with a piston in a percussive drill, comprising:

forming a tubular body of a first material for receiving the piston, the body having an interior surface and an end face;

providing a lining formed of a second material resistant to galling along at least a portion of the interior surface;

after the providing step, hardening at least the end face.

18. The method of claim 17, wherein the hardening step comprises heat treating the body to a temperature that does not impact negatively the second material of the lining.

19. The method of claim 17, wherein the second material comprises bronze, and the heat treating does not cause the bronze to melt.

20. The method of claim 17, wherein the forming and providing steps comprise creating at least a portion of the body including the portion of the interior surface with the lining from a blank comprising the first and second materials.

21. An apparatus for performing drilling, comprising:

a valveless percussive drill including: (1) a piston adapted for reciprocating movement in a longitudinal direction, the piston having an oversized head portion, a stem portion, a cushion portion, and at least one shoulder positioned at least partially between the head portion and the cushion portion; and (2) a tubular body for receiving the piston, the body having a cushion pocket for engaging the cushion portion, an interior surface resistant to galling and a hardened end face for engaging the shoulder of the piston in the event of overtravel in the longitudinal direction.

* * * * *

UNITED STATES PATENT AND TRADEMARK OFFICE

CERTIFICATE OF CORRECTION

PATENT NO. : 8,991,515 B2
APPLICATION NO. : 12/089560
DATED : March 31, 2015
INVENTOR(S) : Morrison It is certified that error appears in the above-identified patent and that said Letters Patent is hereby corrected as shown below:

IN THE CLAIMS

Column 8, line 13, please replace “baying” with -- having --.

Signed and Sealed this
Nineteenth Day of January, 2016

Michelle K. Lee

Michelle K. Lee
*Director of the United States Patent and Trademark Office*